US005793023A

United States Patent [19]

Hong et al.

[11] Patent Number: 5,793,023

[45] Date of Patent: Aug. 11, 1998

[54] MICROWAVE OVEN HAVING ELECTRIC HEATING ELEMENT ROTATABLE BETWEEN HORIZONTAL AND VERTICAL POSITIONS

[75] Inventors: Seok-Weon Hong, Suwon; Hai-Min Lee, Seoul, both of Rep. of Korea

[73] Assignee: Samsung Electronics Co., Ltd., Suwon, Rep. of Korea

[21] Appl. No.: 786,975

[22] Filed: Jan. 24, 1997

[30] Foreign Application Priority Data

| | | | |
|---|---|---|---|
| Jan. 24, 1996 | [KR] | Rep. of Korea | 1996-977 U |
| Feb. 14, 1996 | [KR] | Rep. of Korea | 1996-3569 |
| Oct. 23, 1996 | [KR] | Rep. of Korea | 1996-47743 |

[51] Int. Cl.[6] ..... H05B 6/64

[52] U.S. Cl. ..... 219/685; 219/404; 219/756; 219/702

[58] Field of Search ..... 219/685, 681, 219/404, 756, 702

[56] References Cited

U.S. PATENT DOCUMENTS

| | | | |
|---|---|---|---|
| 2,848,592 | 8/1958 | Mergan | 219/404 |
| 3,281,575 | 10/1966 | Ferguson, Jr. | 219/404 |
| 3,523,181 | 8/1970 | Beasley | 219/404 |
| 4,137,442 | 1/1979 | Tateda | 219/685 |
| 4,357,513 | 11/1982 | Kawata et al. | 219/685 |
| 4,596,914 | 6/1986 | Morino | 219/685 |
| 4,629,850 | 12/1986 | Tanabe | 219/685 |
| 5,534,681 | 7/1996 | Hwang | 219/685 |

*Primary Examiner*—Philip H. Leung

*Attorney, Agent, or Firm*—Burns, Doane, Swecker & Mathis, L.L.P.

[57] ABSTRACT

A microwave oven includes a cooking chamber, a magnetron for performing microwave cooking, and an electric heater element disposed in the cooking chamber for performing convection heat cooking. The heating element is rotatable between vertical and horizontal positions. A heater handling device is connected to the heating element and includes a handle situated outside of the oven for enabling a user to rotate the heating element from outside of the oven.

13 Claims, 10 Drawing Sheets

MICROWAVE OVEN HAVING ELECTRIC HEATING ELEMENT ROTATABLE BETWEEN HORIZONTAL AND VERTICAL POSITIONS

BACKGROUND OF THE INVENTION

This invention relates to a microwave oven having an electric heater element, and more specifically, to a heater handling device enabling the heating element to be manually manipulated.

A microwave oven is a cooking appliance that cooks foodstuff utilizing microwaves of approximately 2450MHz. Recently, in order to satisfy consumer demand, a microwave oven with an electric heater which supplements the normal microwave heating has been developed. There are two methods to transmit heat of a heater to foodstuff: a natural convection method and a forced convection method. In the former, a heater is installed in the cooking chamber of a microwave oven to heat foodstuff by natural convection, and in the latter a heater is installed in the cooking chamber or outside the cooking chamber with a fan provided adjacent thereof to heat foodstuff to be cooked by forced convection.

In such a microwave oven having a heater, a typical heater handling device for changing the position of the heater is disclosed in Japanese Utility Model Laid Open No. 55-1140. FIG. 9 shows a schematic perspective view of the above prior art and FIG. 10 shows a schematic front view of the above prior art. Referring to the drawings, a cooking chamber 2 is provided in the main body 1, and a door 3 is mounted on the front of the main body 1. As shown in FIG. 10, a heater 6 is provided in the cooking chamber 2. The heater 6 is rotatably mounted on the side wall of the cooking chamber 2 by means of a socket 7 so as to allow it to rotate between horizontal and vertical positions.

In such a heater handling device, the heater 6 is typically kept in the horizontal position, only being rotated to the vertical position when the ceiling of the cooking chamber 2 needs cleaning or when barbecue cooking is carried out.

However, in order to rotate the heater 6 between the horizontal and vertical positions, the user must open the door 3 and rotate the heater 6 directly by hand (a bare hand or a gloved hand) or with an additional gripping means. This is very inconvenient and possibly dangerous because the heater 6 reaches very high temperatures. Also, cooking must be interrupted to open the door 3 and manipulate the heater 6.

SUMMARY OF THE INVENTION

The object of this invention is to provide a heater handling device for a microwave oven in which the heater mounted in the cooking chamber can be manipulated from outside to avoid having to open the door of the microwave oven.

As the first aspect to achieve the above object, a microwave oven according to this invention comprises: a main body, a cooking chamber formed in the main body, a heater rotatably mounted in the cooking chamber with terminal portions placed on one side wall of the cooking chamber, and a heater handling device for rotating the heater from the outside of the main body.

As the second aspect to achieve the above object, a microwave oven according to this invention comprises: a main body, a cooking chamber and an electric component compartment separated from each other in the main body, a heater rotatably mounted in the cooking chamber with terminal portions exposed to the electric component compartment, a heater handling device including a heater handling member disposed outside of the main body, and a connecting member passing through the electric components compartment for connecting the heater handling device to the terminal portions.

As the third aspect to achieve the above object, a microwave oven according to this invention comprises: a main body, a cooking chamber formed in the main body, a heater rotatably mounted in the cooking chamber with terminal portions, and a heater handling device one end of which is connected to the heater and the other end of which is extended to the outside of the main body for rotating the heater from the outside thereof.

DETAILED DESCRIPTION OF THE PREFERRED EMBODIMENTS

The preferred embodiments according to this invention will be now described referring to the attached drawings.

Figure 1:
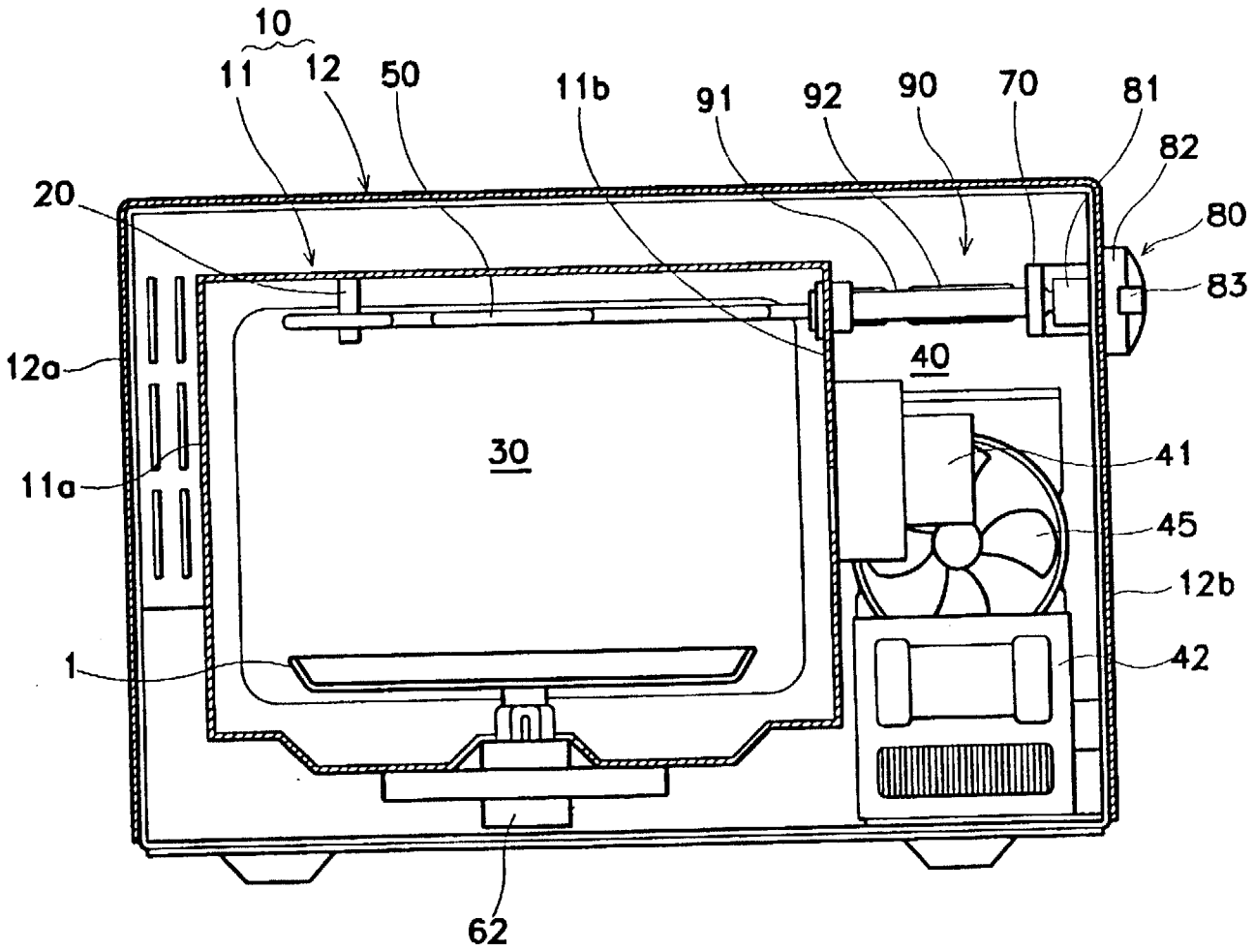
FIG. 1 is a vertical cross-sectional view of a microwave oven according to a first embodiment of this invention which shows a heater rotated to a horizontal position.
Figure 2:
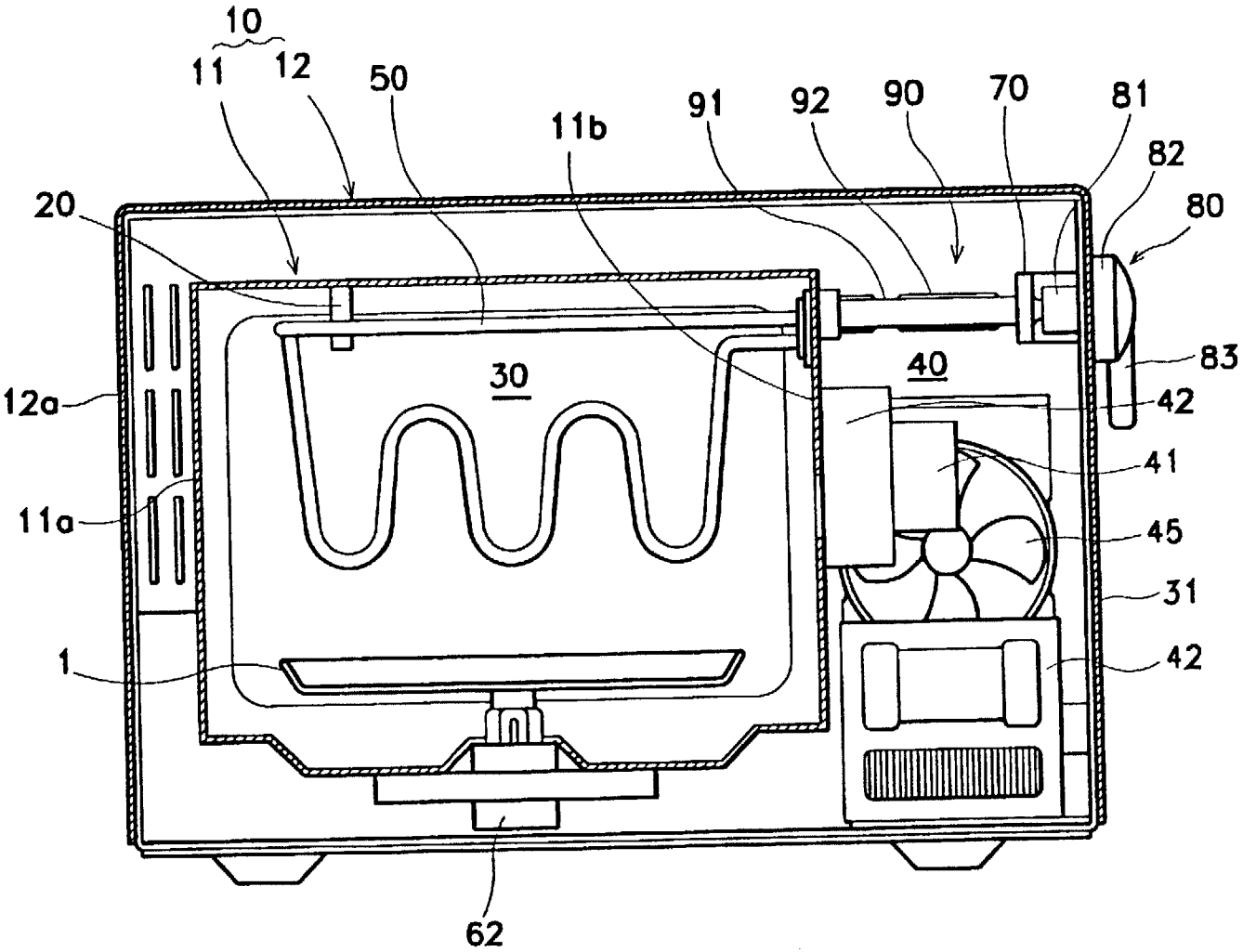
FIG. 2 is a view similar to FIG. 1 which shows the heater rotated to the vertical position.

As shown in FIGS. 1 and 2, in a microwave oven according to this invention, a main body 10 consists of an inner case 11 forming a cooking chamber 30 therein and an outer case 12 enclosing the inner case 11. An electric component compartment 40 is provided between the right side plate **11*b* of the inner case 11 and the right side plate 12*b* of the outer case 12. A heater 50 is installed below the ceiling of the cooking chamber 30, and a tray 61 for receiving foodstuff to be cooked is installed over the bottom of the cooking chamber 30. Both ends of the heater 50 are bent in such a manner that they pass through the right side plate 11*b* of the cooking chamber 30. The terminal portions 51 (see FIG. 4) are positioned in the electric component compartment 40, so that the bent portion of the heater 50 is formed as the free end and the terminal portions 51** are formed as the fixed end.

The free end of the heater 50 is hung from a hooking member 20 fixed to the ceiling of the cooking chamber 30 which rotatably supports the heater 50. The tray 61 is also rotatably movable by a motor 62 disposed under the bottom of the cooking chamber 30.

Figure 3:
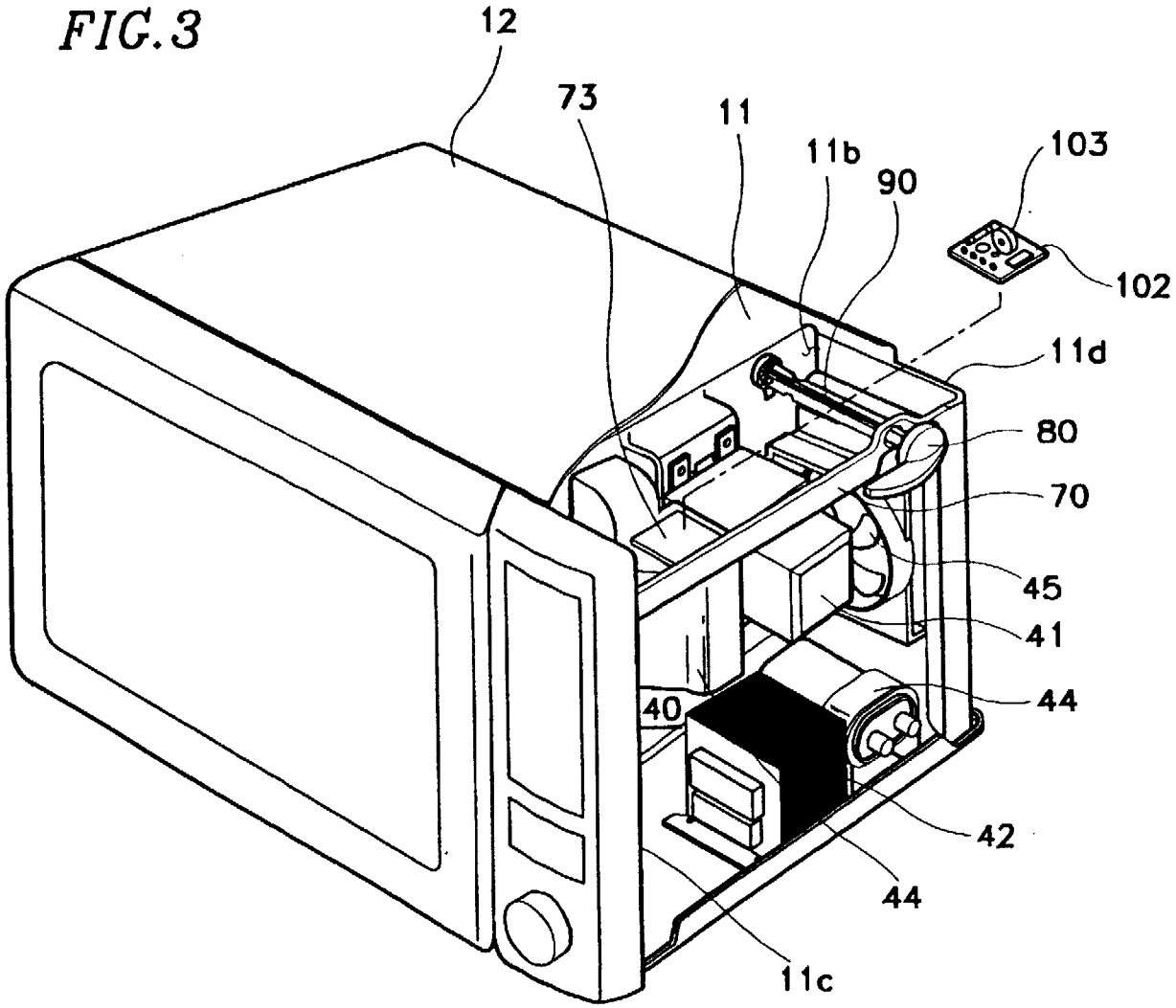
FIG. 3 is a cut away perspective view of a microwave oven to show the installation position of the heater handling device according to the first embodiment.

As shown in FIG. 3, a front extending plate 11*c* and a rear extending plate 11*d* extend from the right side plate 11*b* of the inner case 11 so as to form the front and rear surfaces of the electric component compartment 40, respectively. The upper portions of both extending plates 11*c*,11*d* are supported by a supporting member 70 to prevent the deformation of the plates 11*c* and 11*d*.

In the electric component compartment 40 are installed a magnetron 41 for emitting microwaves to the cooking chamber 30, a high voltage transformer 42 for powering the magnetron 41, a cooling fan 45 for cooling the above components, and a guiding duct 44 for guiding air which has been directed to the electric component compartment 40 by the cooling fan 45 to the cooking chamber 30. The magnetron 41 and the guiding duct 44 are fixed to the right side plate 11*b* of the inner case 11. The high voltage transformer 42 is fixed to the bottom of the electric component compartment 40. The cooling fan 45 is fixed to the rear extending plate 11*d*.

A heater handling device for changing the position of the heater 50 from outside of the main body 10, a characteristic element of this invention, is provided which extends across the upper space of the electric component compartment 40. The heater handling device includes a heater handling member or handle 80 provided outside the outer case 12 and a connecting member 90 for connecting the heater handling member 80 to the terminal portions 51 of the heater 50. The connecting member 90 is disposed across the electric component compartment 40 and the heater handling member 80 is engaged with the end of the connecting member 90.

Figure 4:
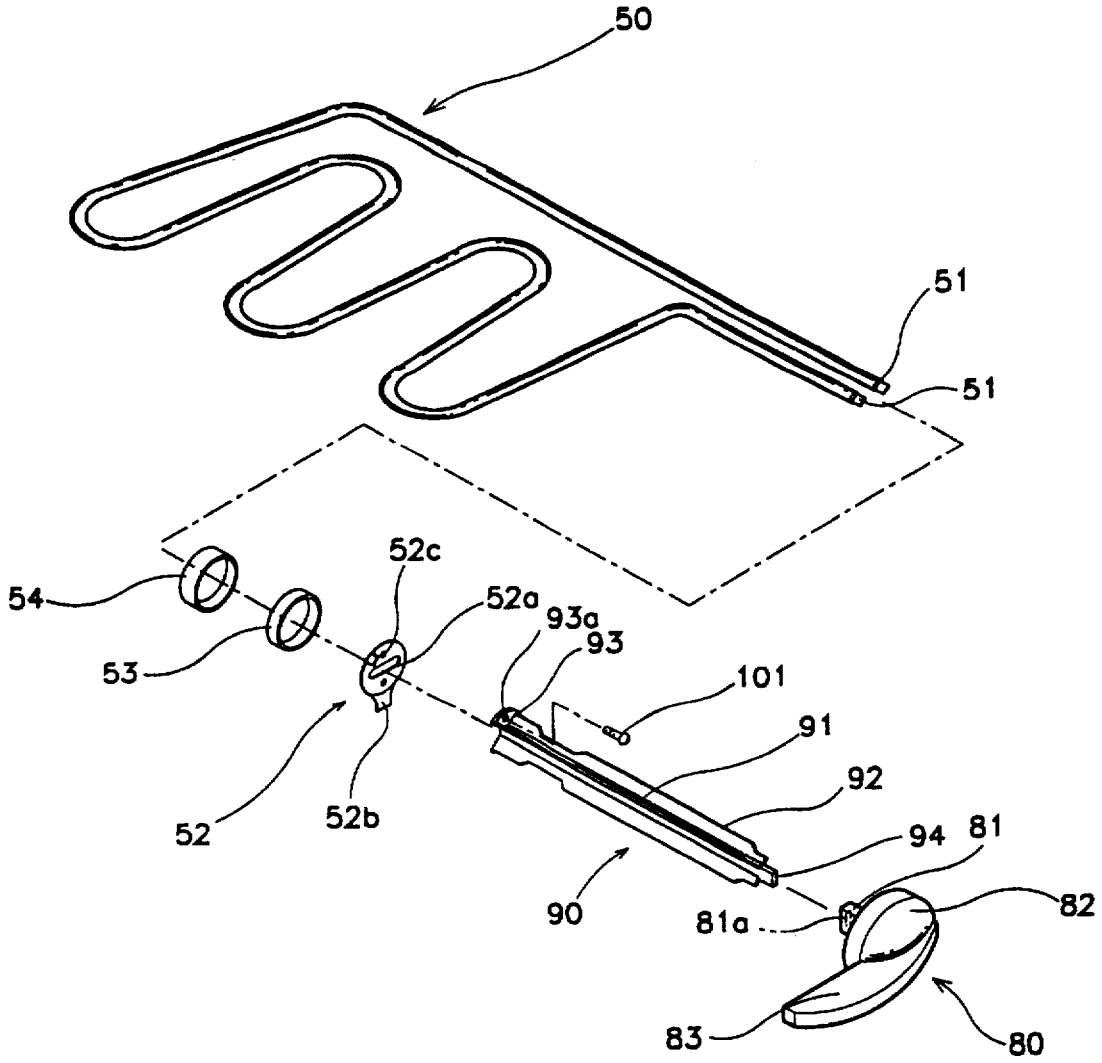
FIG. 4 is an exploded perspective view of the heater handling device according to the first embodiment.
Figure 5:
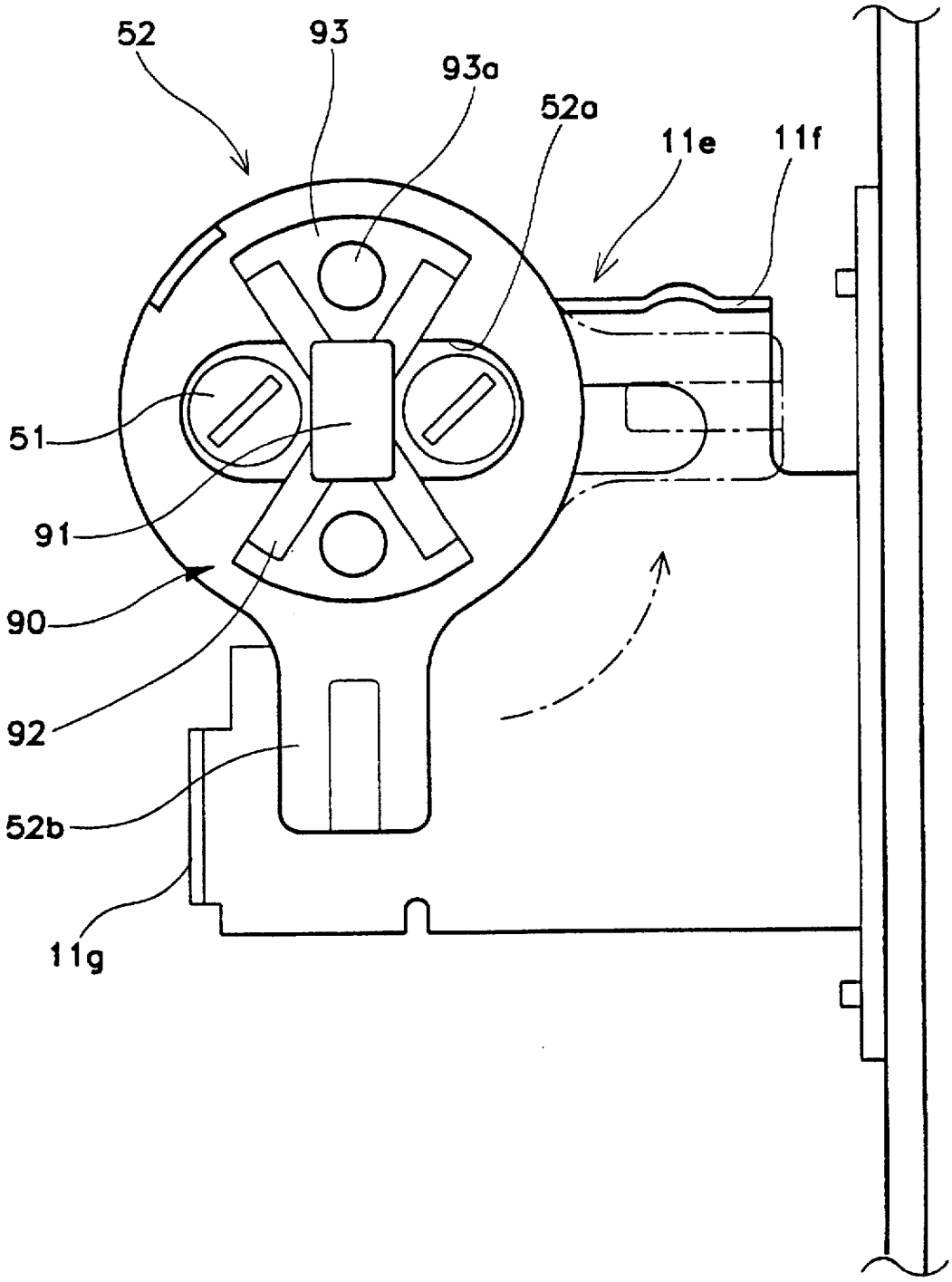
FIG. 5 is a view showing that the heater, the connecting member and the heater handling device in FIG. 4 are coupled to each other.

As shown in FIGS. 4 and 5, the heater handling member 80 includes: a joining element 81, which extends toward the electric component compartment 40 from the right side plate 12*b* of the outer case 12, and is coupled to the connecting member 90; a body 82 disposed outside the outer case 12 from the inner end of which the joining element 81 is projected; and a knob 83 projecting from the body 82. The heater handling member 80 is integrally formed by an injection molding operation.

The connecting member 90, which is made from plastic injection material, includes a connecting bar 91 through which the terminal portions 51 of the heater 50 and the heater handling member 80 are connected with each other, and a plurality of ribs 92 arranged on the outer surface of the connecting bar 91 for reinforcing the connecting bar 91.

In order to join the heater 50 to the connecting member 90, a joining plate 52 and a flange 93 are fitted to the terminal portions 51 of the heater 50 and the connecting member 90, respectively. Further, screw holes 52*c* and 93*a* are formed on the joining plate 52 and the flange 93, respectively, through which screws 101 pass to connect the heater 50 to the connecting member 90. On the joining plate 52 is also formed a slit 52*a* through which the terminal portions 51 of the heater 50 pass in such a manner that the heater 50 can be rotated along with the joining plate 52. The elements that are indicated by the numerals 53 and 54 are a spacer and a heat insulating member, respectively.

Shown in FIG. 5 is a restraint plate 11*e* fixed to the outer surface of the right side plate 11*b* of the inner case 11 for restraining the rotating range of the joining plate 52. A horizontal restraining projection 11*f* and a vertical restraining projection 11*g* are provided at the upper and lower portions of the restraint plate 11*e*, respectively, and a stopping projection 52*b* is provided on the joining plate 52 so as to be engageable with the projections 11*f* and 11*g*.

Figure 6:
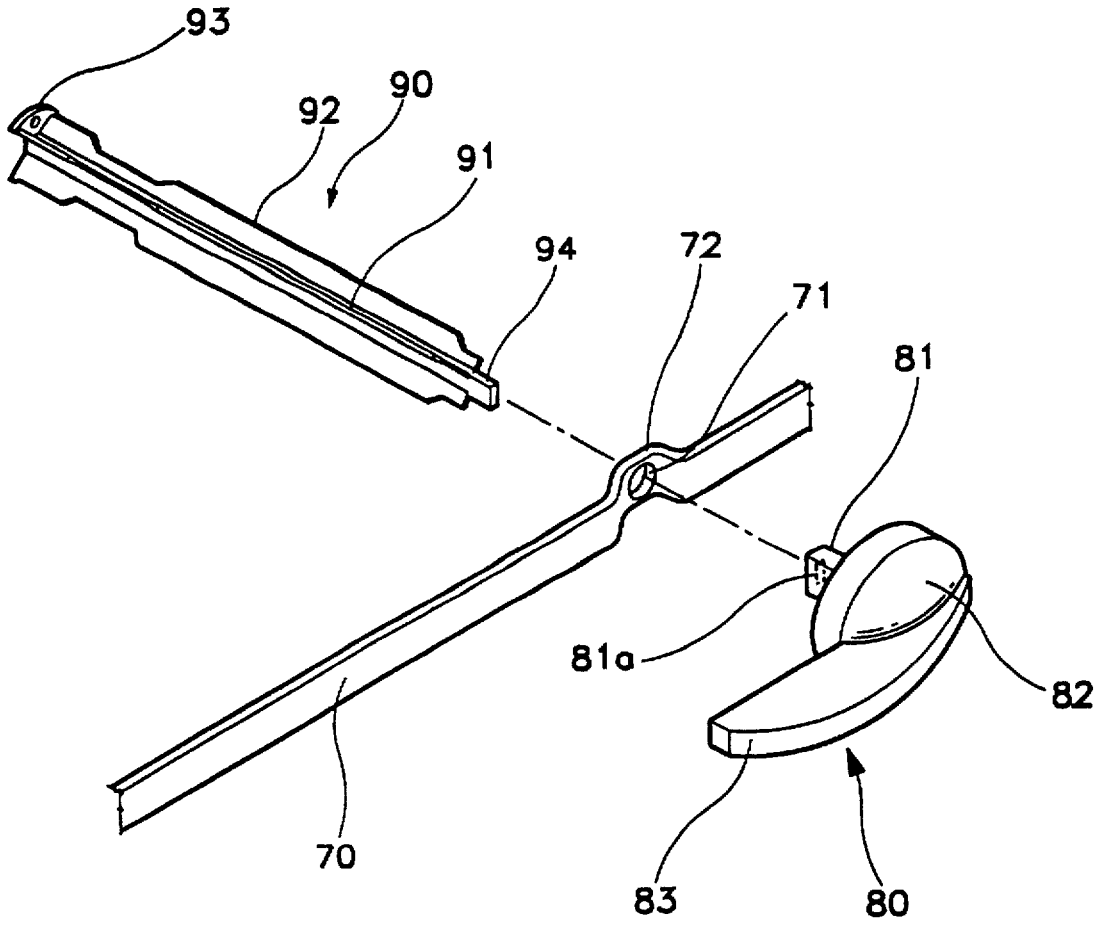
FIG. 6 is an exploded perspective view illustrating the coupling method of the supporting member, the connecting member and the heater handling device in FIG. 5.

As shown in FIG. 6, for joining the connecting member 90 with the heater handling member 80, there is provided on the supporting member 70 a bent portion 72 bent toward the electric component compartment 40 and having a hole 71 there through. Thus, the connecting member 90 passes through the hole 71 of the bent portion 72 and is inserted into the heater handling member 80. In order to easily attach or remove the heater handling member 80 to or from the connecting member 90, an inserting portion 94 is provided on the connecting member 90 and a receiving hole 81*a* is provided in the joining element 81 of the heater handling member 80. With such a structure, the heater handling member 80 is not deeply protruding from the outer case 12 because the connecting member 90 and the heater handling member 80 are joined to each other in the bent portion 72 of the supporting member 70. Also the connecting member 90 is firmly supported within the supporting member 70 by the reinforcing function of the bent portion 72.

A shown in FIG. 3, on the supporting member 70 there is provided a pad plate 73 extending toward the electric component compartment 40 on which an auxiliary printed circuit board 102 (hereinafter described as PCB) is mounted. The auxiliary PCB 102 has a noise filter 103 thereon. A main PCB (not shown) is disposed on the back side of the front extending plate 11*c*. Because the auxiliary PCB 103 having the noise filter 102 is horizontally mounted on the pad plate 73, the mounting work is very convenient.

The operation of the first embodiment of this invention will be now described.

The cooking process of foodstuff by microwaves and heating of the heater is the same as that of the prior art microwave oven, and therefore description of the cooking process will be omitted and only the manipulating process of the heater 50 will be described in detail.

FIG. 1 illustrates the heater 50 rotated to the horizontal position close to the ceiling of the cooking chamber 30. Because the heater 50 in this position is not an obstacle to the cooking space of the cooking chamber 30, it is used for general cooking.

As shown in FIG. 2, the heater 50 is rotated to the vertical position to facilitate the cleaning of the ceiling of the cooking chamber 30 or for barbecue cooking. The heater 50 is rotated by the user turning the knob 83 of the heater handling member 80. That is, if the knob 83 is turned, the heater handling member 80, the connecting member 90, and the heater 50 are rotated together.

The rotating range of the heater 50 in the cooking chamber 30 is limited to 90 degrees allowing it to be in the vertical position and the horizontal position. More specifically, the knob 83 can not be further rotated when the stopping projection 52*b* of the joining plate 52 is contacting the restraining projection 11*f* of the restraint plate 11*e*, thereby preventing the heater 50 from being rotated beyond the vertical position. In this state, the user can only turn the knob 83 reversely to rotate the heater 50 back to the horizontal position.

Figure 7:
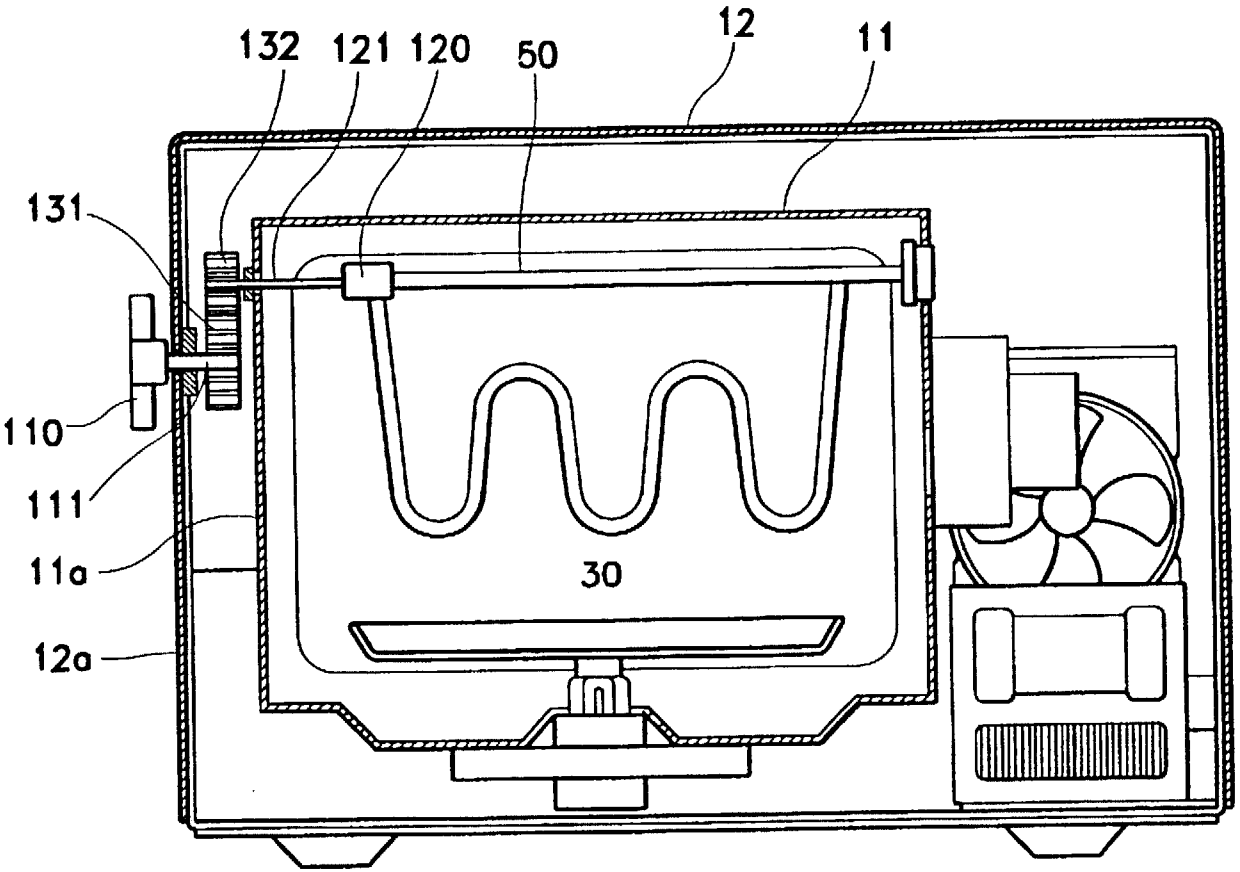
FIG. 7 is a vertical cross-sectional view of a microwave oven according to a second embodiment of this invention.
Figure 8:
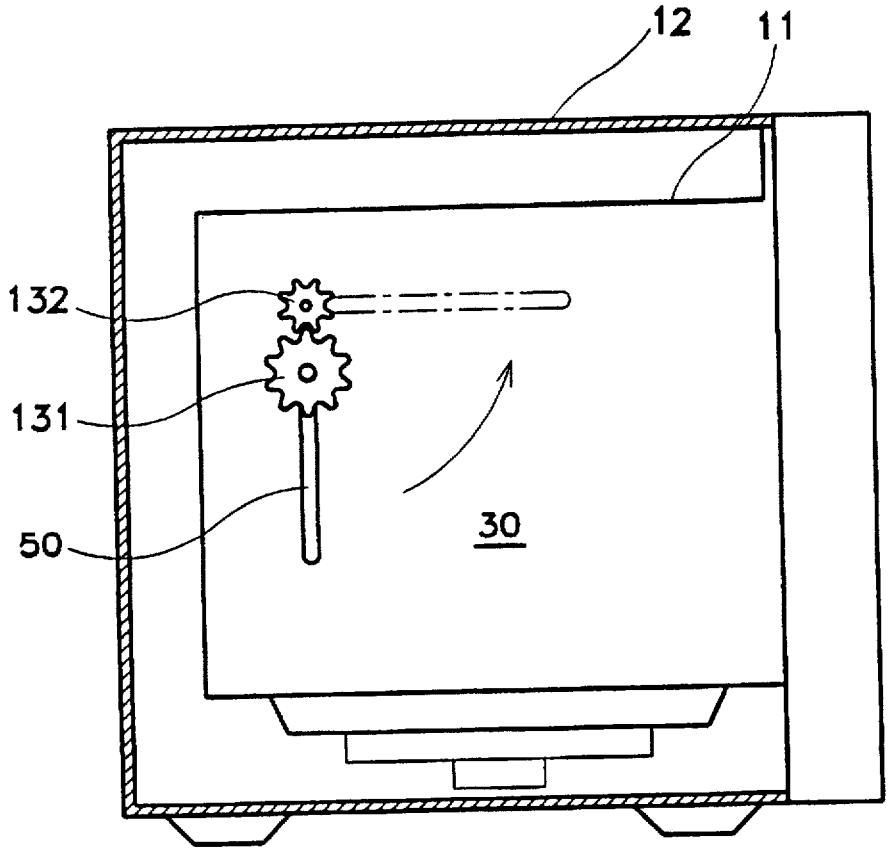
FIG. 8 is a schematic view showing the heater rotated to the horizontal and vertical positions in the second embodiment.
Figure 9:
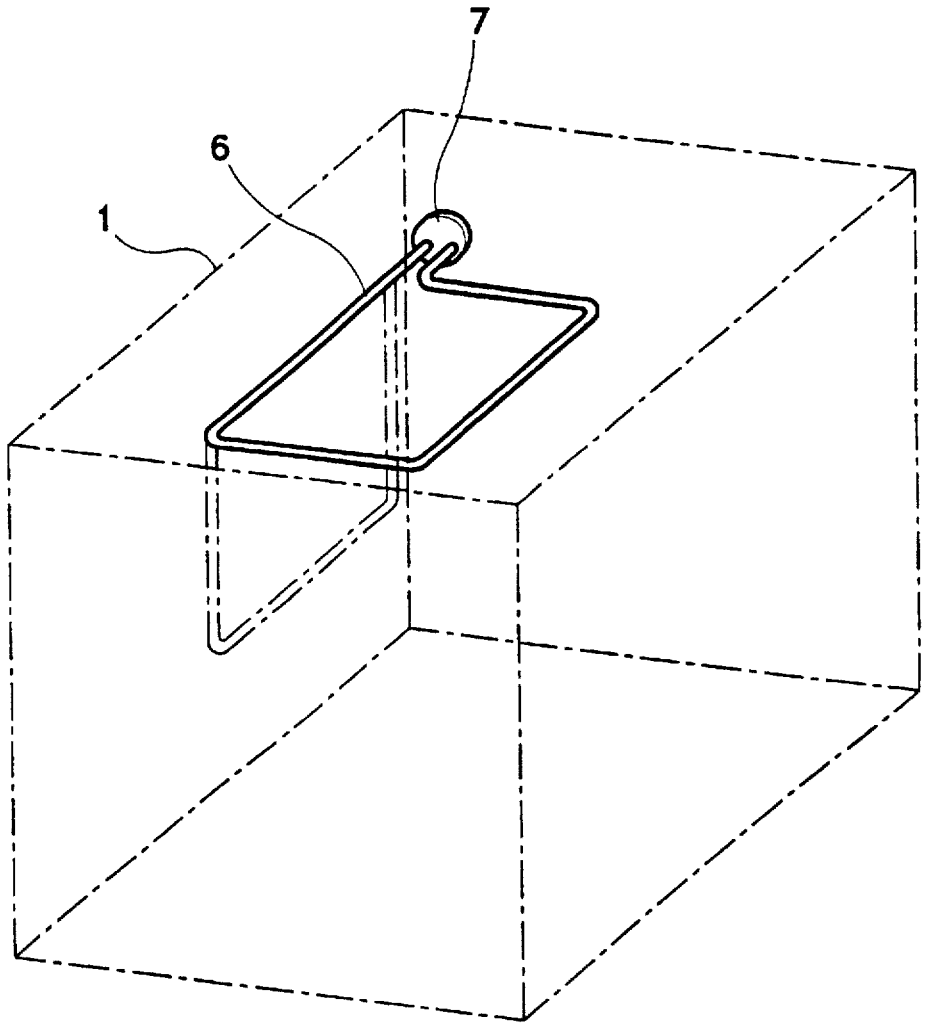
FIG. 9 (PRIOR ART)
FIG. 9 is a schematic view of a microwave oven having a heater according to a prior art.
Figure 10:
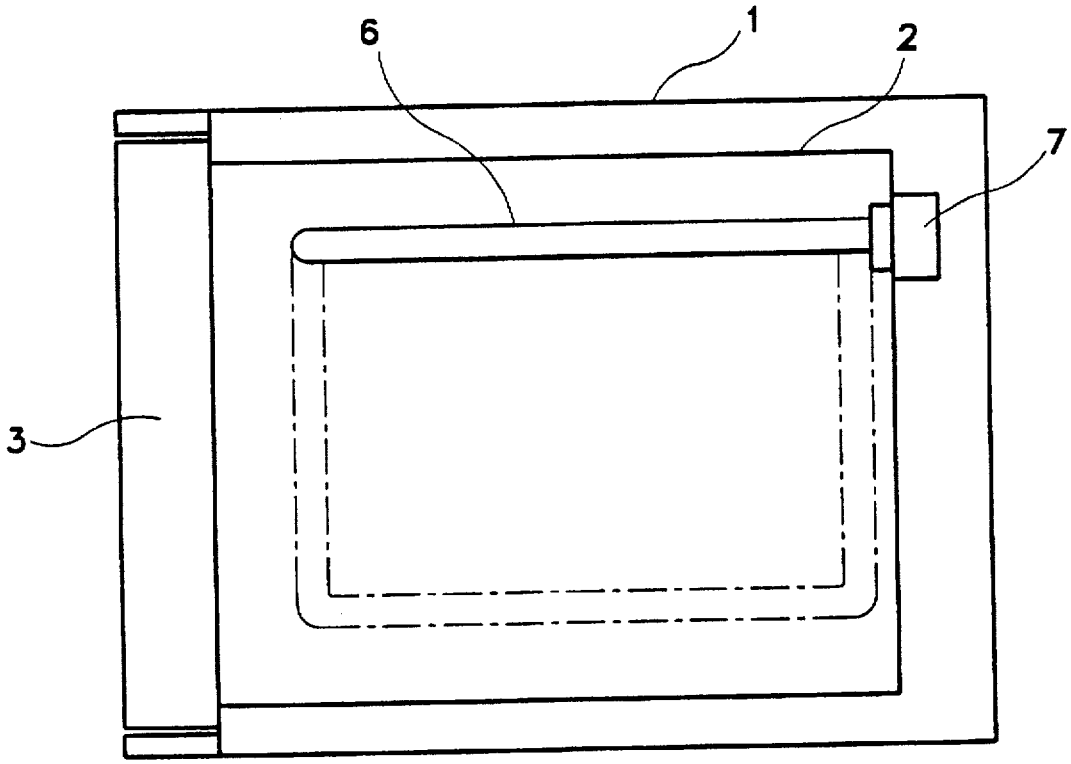
FIG. 10 (PRIOR ART)
FIG. 10 is a schematic view showing the operated positions of the heater coupled to the heater handling device in FIG. 9.

FIGS. 7 and 8 show the second embodiment of this invention. As shown in the drawings, the heater handling device is constructed of a plurality of gears. A heater supporting member 120 for rotatably supporting the heater 50 is provided on the left side plate 11*a* of the cooking chamber 30. A heater handling member 110 is disposed at the outer surface of the left side plate 12*a* of the outer case 12 to manually manipulate the heater 50 from the outside thereof. The rotating shaft 121 of the heater supporting member 120 extends to the outside of the cooking chamber 30 passing through the left side plate 11*a* of the inner case 11. By means of the rotating shaft 121, the heater supporting member 120 is integrally rotated with the heater 50. The rotating shaft 111 of the heater handling member 110 passes through the outer case 12 and the heater handling member 110 is installed on the shaft 111 outside of the outer case 12. A plurality of gears 131 and 132 are arranged between the rotating shaft 111 of the heater handling member 110 and the rotating shaft 121 of the heater supporting member 120, so that the rotating force of the heater handling member 110 is transmitted to the heater supporting member 120. The gears 131 and 132, whose teeth include engaged with each other, are a driving gear 131 connected to the rotating shaft 111 of the heater handling member 110 and a driven gear 132 connected to the rotating shaft 121 of the heater supporting member 131. By mean s of the gears 131 and 132, the heater 50 is also prevented from sagging under its own weight, and is rotated by only a small rotating force.

A scale (not shown) is marked with degrees on the outside of the outer case 12, on which the heater handling member 110 is mounted, corresponding to the rotational displacement of the heater 50 so that the user can identify the position of the heater 50 without looking inside the cooking chamber 30.

In the operation of the heater handling device according to the second embodiment of this invention, the user can adjust the position of the heater 50 between the vertical and horizontal positions by rotating the heater handling member 110, using the scale marked on the outer surface of the outer case 12 for guidance. When the heater handling member 110 is rotated, its rotating force is transmitted to the heater 50 through the driving gear 131 and the driven gear 132. As previously mentioned, sagging of the heater 50 under its own weight is prevented by the teeth engagement of the driving gear 131 and the driven gear 132.

As can be understood from the above detailed description, the use of the inventive microwave oven is very convenient because the heater mounted in the cooking chamber can be manipulated from the outside thereof without opening the door of the microwave oven.

What is claimed is:

1. A microwave oven comprising:

a main body having upright front and rear plates interconnected by a pair of upright side plates defining an exterior of said main body;

a cooking chamber disposed within said main body between said side plates;

a microwave generator disposed in said main body for supplying microwaves to said cooking chamber;

an electric heater element disposed in said cooking chamber;

a connector fixed to said heater element and extending toward one of said side plates for rotation about a longitudinal axis of said connector, said axis extending through an upper rear portion of said cooking chamber in a direction parallel to said rear plate and perpendicular to said one side plate; and a manually grippable element disposed to the outside of said one side plate and connected to said connector for rotating said connector and said heater element about said axis, said heater element being rotatable within a 90 degree range between a first position oriented horizontally in an upper portion of said cooking chamber, and a second position oriented vertically in a rear portion of said cooking chamber.

2. The microwave oven according to claim 1 wherein said connector includes a radially outwardly protruding reinforcing rib which extends longitudinally along said connector.

3. The microwave oven according to claim 1 wherein said manually grippable element is rigidly fixed to said shaft.

4. The microwave oven according to claim 1, further including an electric component compartment disposed in said main body between said cooking chamber and said one side plate, said microwave generator disposed in said electric component compartment, said connector extending across said electric component compartment.

5. A microwave oven comprising:

a main body having a cooking chamber disposed therein;

a microwave generator for supplying said cooking chamber with microwaves;

an electric heating element rotatably mounted in said cooking chamber;

a manually rotatable heater handling device accessible from outside of said main body; and a manually rotatable connecting bar for transmitting rotation from said handling device to said heating element, said connecting bar extending through a wall of said cooking chamber and including a radially outwardly protruding reinforcing rib which extends longitudinally along said connecting bar.

6. The microwave oven according to claim 5 wherein said heating element includes two parallel ends defining terminals for connecting said heating element to an electrical power source, said terminals connected to an end of said connecting bar.

7. The microwave oven according to claim 5 wherein said handling device includes a manually grippable knob connected to said connecting bar for rotating said connecting bar, said knob disposed exteriorly of said main body.

8. A microwave oven comprising:

a case structure forming a cooking chamber, said case structure including an inner side plate forming a side wall of said cooking chamber, and an outer side plate arranged parallel to said inner side plate for forming an electric component compartment therebetween;

a microwave generator disposed in said electric component compartment for supplying microwaves to said cooking chamber;

an electric heating element rotatably disposed in said cooking chamber and including two ends defining electric terminals, said terminals being rotatably mounted on said inner side plate, a manually rotatable handling member rotatably mounted on said outer side plate and including a knob accessible from outside of said case structure, said knob carrying a joining element; and a rotatable connector extending across said electric component compartment and interconnecting said joining element and said terminals for transmitting rotation therebetween.

9. The microwave oven according to claim 8 wherein said connector includes a joining plate receiving said terminals, a connecting bar having one end secured by a separate fastener to said joining plate, said joining element of said knob being mounted on an opposite end of said connecting bar by a sliding fit and being rotatable with said connecting bar.

10. The microwave oven according to claim 8 wherein said connecting structure includes a connecting bar having a radially outwardly protruding reinforcing rib which extends longitudinally along said connecting bar.

11. The microwave oven according to claim 8, wherein said case structure includes front and rear plates interconnected by said inner and outer side plates, a supporting member disposed in said electric component compartment and having opposite ends fixed to said front and rear plates, respectively, said supporting member including a hole through which said connector extends.

12. The microwave oven according to claim 11 wherein said supporting member includes a bent portion displaced farther from said outer plate than a remainder of said supporting member, said hole formed in said bent portion.

13. The microwave oven according to claim 11 further including a pad plate mounted on said supporting member and disposed in said electric component compartment, a printed circuit board mounted on said pad plate.

* * * * *